US010213005B2

(12) United States Patent
Vanoncini et al.

(10) Patent No.: US 10,213,005 B2
(45) Date of Patent: Feb. 26, 2019

(54) CONTAINER WITH IMPROVED OPENING SYSTEM

(71) Applicant: BRIVAPLAST S.R.L., Milan (IT)

(72) Inventors: Stefano Vanoncini, Milan (IT); Anna Poletto, Milan (IT); Ambrogio Fumagalli, Milan (IT); Giuseppe Ghirardi, Milan (IT)

(73) Assignee: BRIVAPLAST S.r.L., Milan (IT)

( * ) Notice: Subject to any disclaimer, the term of this patent is extended or adjusted under 35 U.S.C. 154(b) by 150 days.

(21) Appl. No.: 15/516,288

(22) PCT Filed: Sep. 30, 2015

(86) PCT No.: PCT/IB2015/057498
§ 371 (c)(1),
(2) Date: Mar. 31, 2017

(87) PCT Pub. No.: WO2016/051359
PCT Pub. Date: Apr. 7, 2016

(65) Prior Publication Data

US 2017/0303664 A1 Oct. 26, 2017

(30) Foreign Application Priority Data

Oct. 1, 2014 (IT) ..... MI20140300 U

(51) Int. Cl.
*A45D 34/04* (2006.01)
*A45D 40/26* (2006.01)
(Continued)

(52) U.S. Cl.
CPC ..... *A45D 40/26* (2013.01); *A45D 40/02* (2013.01); *A45D 40/10* (2013.01); *A45D 40/265* (2013.01);
(Continued)

(58) Field of Classification Search
None
See application file for complete search history.

(56) References Cited

U.S. PATENT DOCUMENTS

2013/0343798 A1 12/2013 Delage

FOREIGN PATENT DOCUMENTS

EP 2474482 A1 7/2012

OTHER PUBLICATIONS

International Search Report for PCT/IB2015/057498 dated Feb. 26, 2017.

*Primary Examiner* — David Walczak
*Assistant Examiner* — Joshua Wiljanen
(74) *Attorney, Agent, or Firm* — Pearne & Gordon LLP

(57) ABSTRACT

Container for liquid or paste products of the type generically consisting of a tank and of a closing capsule, a stem being associated with suitable retaining structures with said capsule, said stem supporting an applicator, between said capsule and said stem a spring being arranged, said tank consisting of a cylindrical body, at the top of which there is provided a neck, apt to the insertion of the stem and to the tightening of the capsule to said tank, on the external periphery of said neck being provided shaped relief guiding and retaining members for peg members internally projecting from said capsule characterized in that on said capsule there is provided a fastening portion with a cylindrical coupling ring containing a rotating ring provided with at least one retaining tooth and with an engagement with said shaped relief guiding members provided on said neck.

14 Claims, 9 Drawing Sheets

(51) Int. Cl.

| | |
|---|---|
| ***A45D 40/02*** | (2006.01) |
| ***A45D 40/10*** | (2006.01) |
| *A45D 40/00* | (2006.01) |

(52) U.S. Cl.
CPC ..... *A45D 34/045* (2013.01); *A45D 40/00* (2013.01); *A45D 2200/05* (2013.01)

CONTAINER WITH IMPROVED OPENING SYSTEM

BACKGROUND

This is a National Stage of PCT international application PCT/IB2015/057498, filed on Sep. 30, 2015, which claims the priority of Italian Patent Application No. 202014902297603 (MI2014U000300) entitled "CONTAINER WITH IMPROVED OPENING SYSTEM", filed on Oct. 1, 2014, both of which are incorporated herein by reference in their entirety.

The present invention relates to a container for liquid or paste products, in particular for cosmetics, provided with an opening system apt to allow quick opening and to simultaneously guarantee sealing when it is not in use.

The use of instruments for the collection and subsequent distribution of paste, liquid or gel products, apt to be distributed on the surfaces of interest, has been known in the cosmetic sector for a long time. Typically, such instruments consist of a container consisting of a tank, apt to contain the substance to be applied, of a stem which carries at the distal end thereof an applicator, and of a closing member which usually consists of a cover kept in engagement with the top of the stem-shaped member. Typically, in order to guarantee the sealing and thus avoid the undesired spilling of liquid or paste and the hardening of the substances to be applied, caused by contact with air, it is provided that on the tank and cover there are provided screw threading and counterthreading.

In the past some problems have arisen with this type of conventional engagement. In particular the evident difficulty by some categories of users has been detected to impart to the cover the twisting force necessary for opening or closing the container, for example because they suffer from syndromes to the upper limbs, or are elderly. Finally, is has been identified as particularly uncomfortable to have to engage both hands to be able to proceed to the opening and to the closing of the container.

BRIEF SUMMARY

In order to overcome the above-cited problems, the Applicant has provided to manufacture (and protect with patent IT 1403622) a container wherein at the top of the tank there are provided relief shaped guiding and retaining members, mutually separated and separated from a crown located at the bottom of the tank bottleneck through a channel, while within the capsule a shaped rotating ring is housed, provided with bottom appendixes, at the ends of which peg-shaped members protrude having a size which allows them to engage with said channel and to sealingly engage with said shaped members.

Although it brilliantly solves the set object, the solution now described, and in due time protected, still has margins for improvement.

In particular, it has been detected that the mounting of the structure summarily described here has proved rather complex during the mounting step of the various components.

The object of the present invention is to reduce the mounting complexity of the elements make up the cosmetic product container maintaining a steady engagement between the single members.

Moreover, it could be detected that in certain cases the solution of appendixes projecting from the rotating ring body can determine stability problems of the pegs projecting therefrom, and the resulting need for a very high control of the reliability standards before filling with the cosmetic material.

A further object is therefore to provide a closing system which provides greater stability in the engagement between the pegs and the shaped members.

Moreover, during the experiments it has been possible to detect that the opening movement was too short, and often little easy.

A further object is therefore to improve the ergonomics of the solution previously adopted, guaranteeing improved travel which makes the opening movement longer, and hence easier.

Said objects are obtained through a container for liquid or paste products having the features reported in claim 1). The dependent claims relate to some preferred properties of the invention for which protection is now sought.

BRIEF DESCRIPTION OF THE DRAWINGS

The container according to the invention is now going to be described with reference to the attached drawings, wherein:

FIG. 4 is the perspective view of the tank body of the container according to the invention, of which;

FIG. 7 is the front view of the rod member of the container according to the invention, of which

FIG. 8 is a front view of the rotating ring member of the container according to the invention, of which

DETAILED DESCRIPTION

Figure 1:
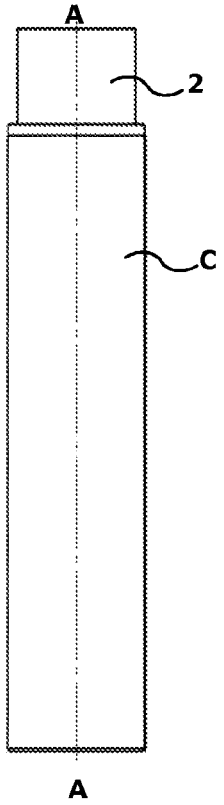
FIG. 1 is a front view of a container according to the invention, ready for marketing.
Figure 3:
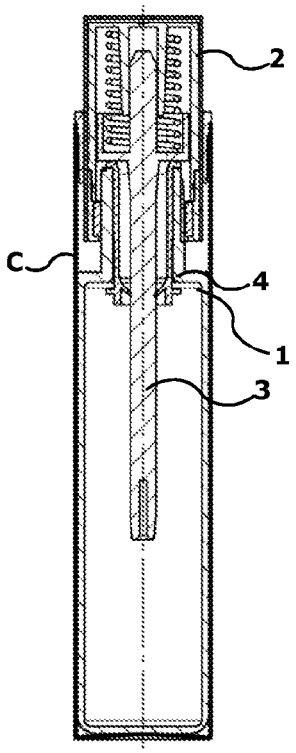
FIG. 3 is the section view along the line A-A' of the container of FIG. 1
Figure 4:
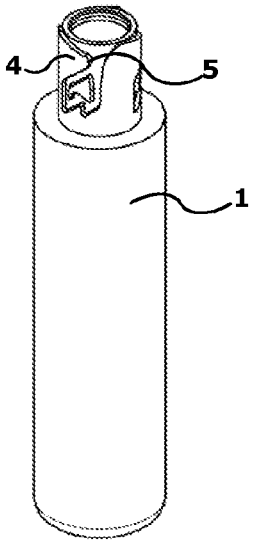
Figure 2:
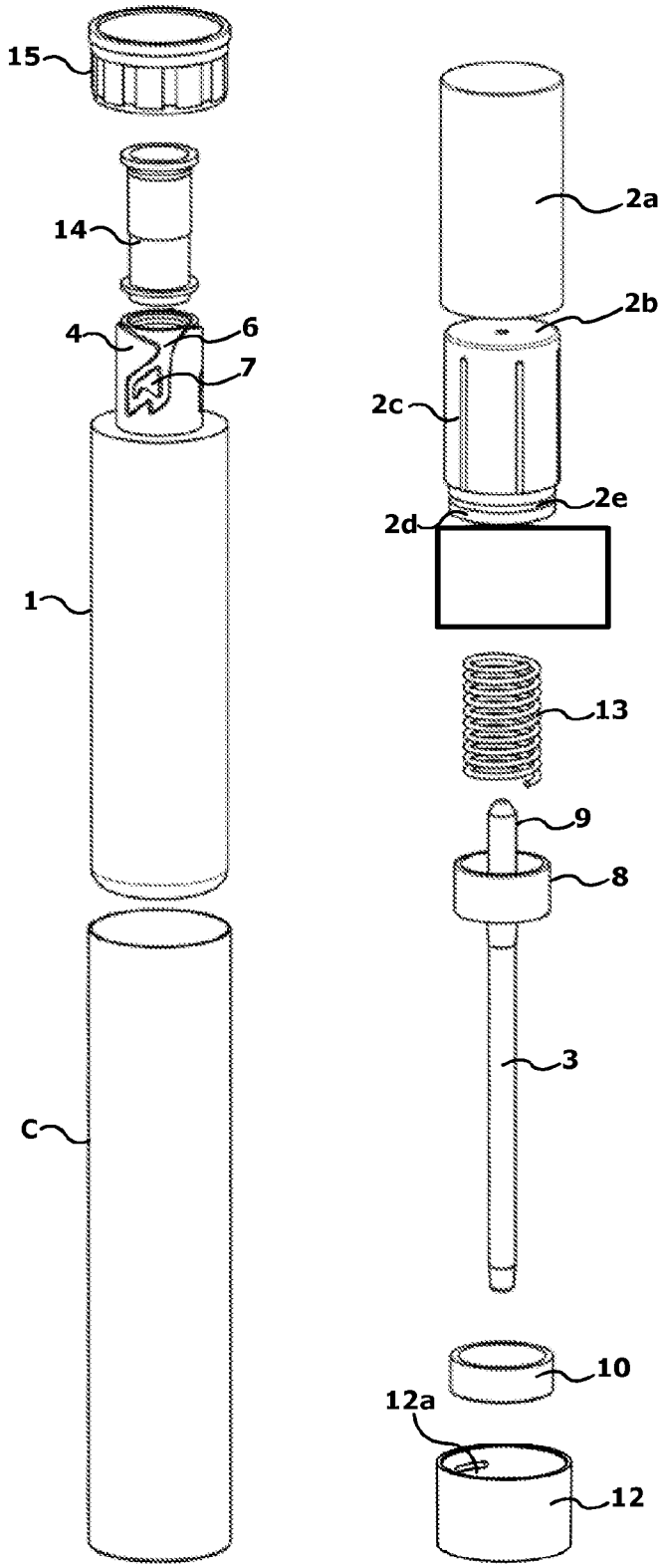
FIG. 2 is the exploded view of the container according to the invention.
Figure 5:
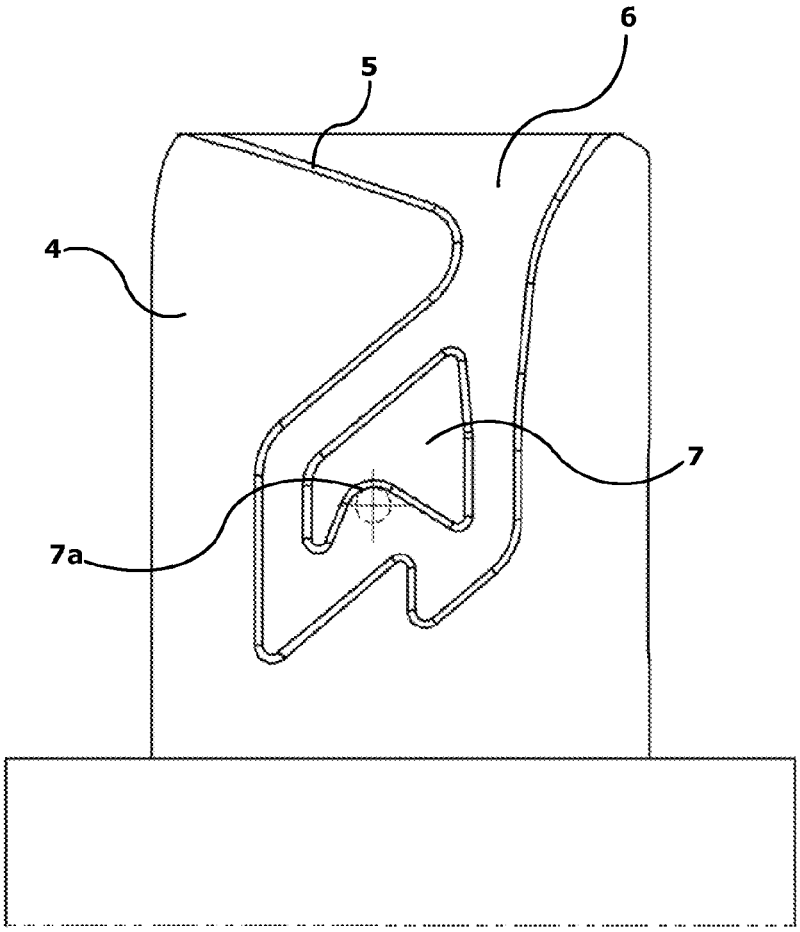
FIG. 5 is the enlarged view of a detail.

The container according to the invention is of the conventional type, generically consisting of a tank 1, preferably covered with a decorating and protecting sleeve C, and of a closing capsule 2 with which a stem 3 is associated through suitable retaining means.

Tank 1 consists of a cylindrical body, at the top of which a neck 4 is provided, apt to the insertion of stem 3 into tank 1 and to the relative tightening of capsule 2. Neck 4 has on the outer surface thereof a shaped base crown 5, apt to define a rail 6 which skirts a series of retaining brackets 7, said rail 6 corresponding in certain portions to the top of said neck 4.

As can be seen from the drawings, the axis of said brackets 7 is perpendicular with respect to the axis of tank 1.

Figure 6:
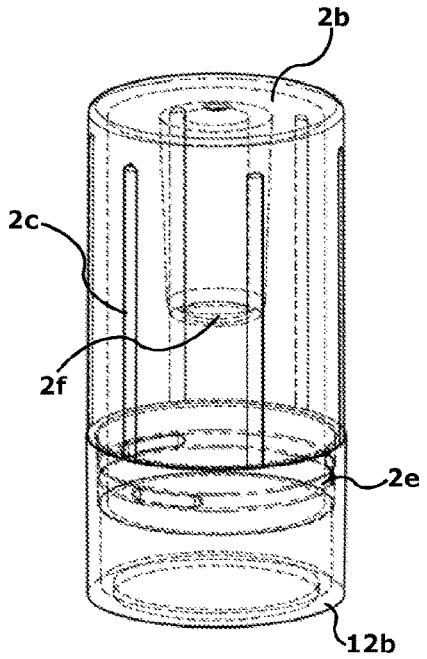
FIG. 6 is a clear perspective view from top of the capsule member of the container according to the invention.
Figure 6B:
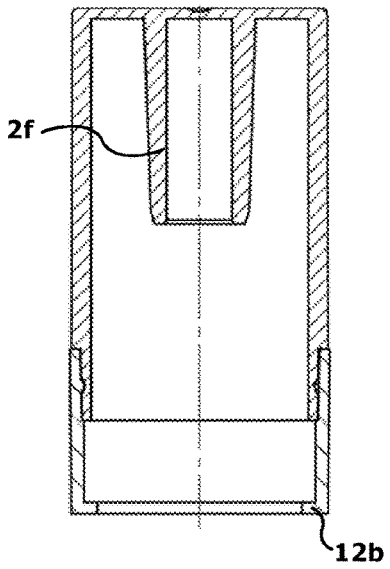
FIG. 6*b* is the section view along the line B-B' of FIG. 6*a;*
Figure 6A:
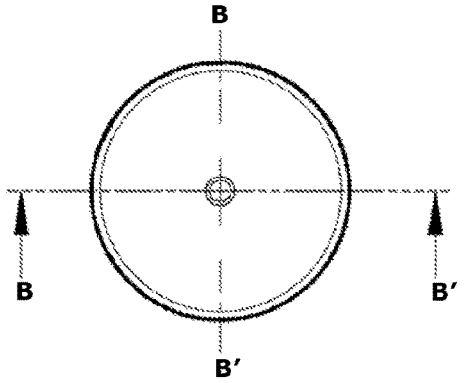
FIG. 6*a* is the top view of the capsule of FIG. 6.

Capsule 2 consists of an external, ornamental, cylindrical hood 2*a*, which houses inside the actual capsule body 2*b*. As illustrated in FIGS. 6, 6*a* and 6*b*, it carries externally longitudinal notches 2*c* apt to the engagement with complementary grooves (not shown) provided within hood 2*a*. At the bottom of said capsule body 2*b* there is integrally provided a smaller-diameter cylindrical appendix 2*d*, along the outer surface of which an annular groove 2*e* is obtained.

From the top of the capsule body an elongated cylindrical crown (2*f*) projects internally, perforated at the distal end housing the top of said stem 3.

Figure 7:
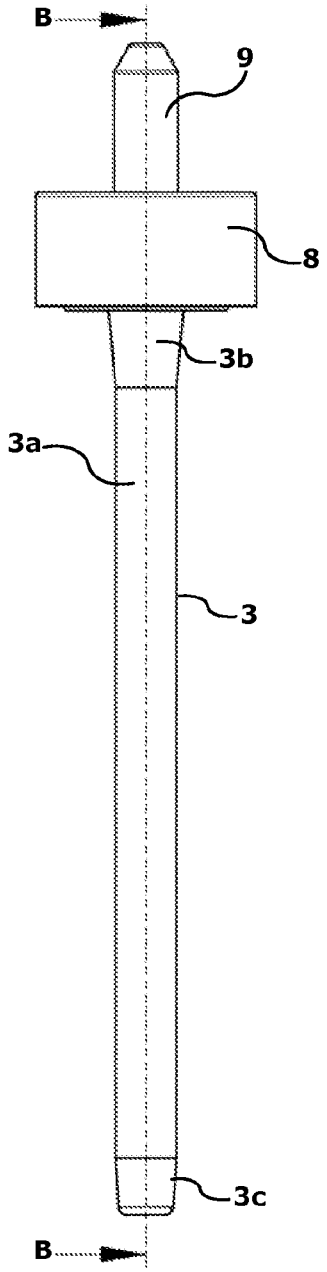
Figure 7A:
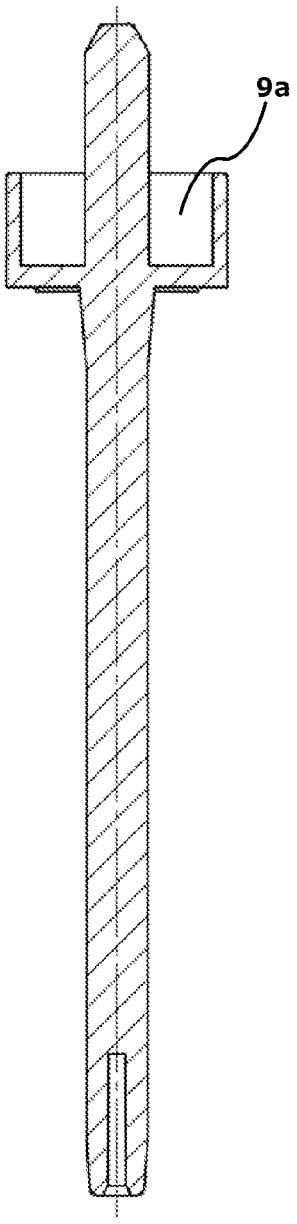
FIG. 7*a* is the section view of the rod member of the container according to the invention.

Stem 3, illustrated in FIGS. 7 and 7*a*, is of the type generically consisting of a central body 3*a*, surmounted at the proximal end by a trunco-conical tapering 3*b* supporting a collar 8, and which carries in turn at the distal end a trunco-conical tapering 3*c* for the housing of an applicator member (not shown). From said collar 8—axially with said stem 3—a cylindrical head member 9 projects.

Figure 8:
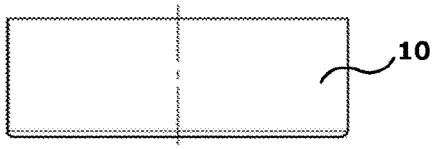
Figure 8A:
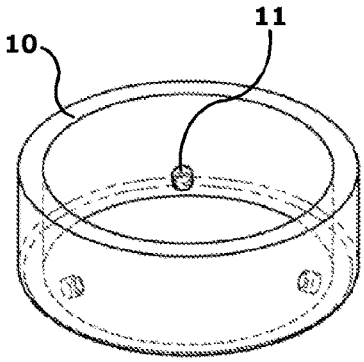
FIG. 8*a* is a perspective view.
Figure 8B:
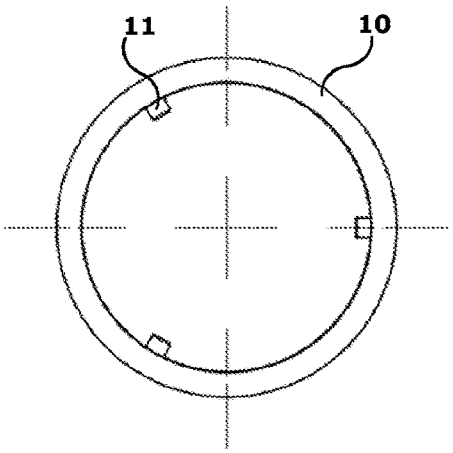
FIG. 8*b* is a top view.
Figure 9:
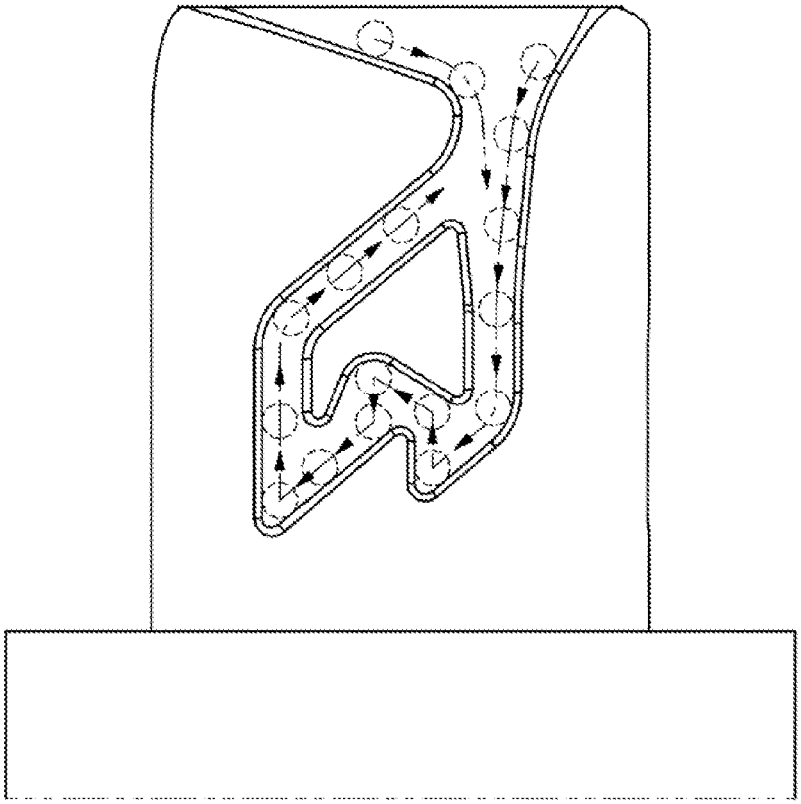
FIG. 9 is the view of FIG. 5, wherein the engagement is schematically and kinematically shown which is formed with the engagement members of FIGS. 8 and 8*b;*

Finally, to guarantee the movement and the engagement of capsule 2 with respect to container 1, a rotating ring 10 is provided, as illustrated in FIGS. 8, 8*a* and 8*b*, consisting of a cylindrical ring of a diameter substantially identical to said collar 8, from the inner surface of which at least a peg 11 projects. Preferably, the pegs are at least two, and even more preferably they are three or four, depending on the number of brackets 7 provided on the neck of tank 1.

In order to keep capsule 2 connected with rotating ring 10 and stem 3 there is provided a cylindrical coupling ring 12, internally provided with protruding notches 12*a* having a semi-toroidal profile. Protruding notches 12*a* have such a diameter as to be able to be inserted by pushing into the annular groove 2*e* of capsule 2. Moreover, in order to keep rotating ring 10 in position, coupling ring 12 has, at the distal end thereof, an annular abutment recess 12*b* (FIGS. 6, 6*b*).

Arranged between collar 8 and capsule body 2*b* there is a spring 13 apt to guarantee the quick and automatic release movement of capsule 2 in the operation of the container, as will be better understood from the following explanation.

In order to improve product quality, and to reach the set objects, it has been furthermore provided to insert a cylindrical scraper 14, known per se in the art, into neck 4.

Preferably, a gasket 15 made of plastic material is also provided, apt to align capsule 2 with respect to tank 1.

Preferably, sleeve C extends in height until it covers from view neck 4 and it acts as guide of closing capsule 2 for the correct centring of the entire closing system.

From the preceding description the setting up of the container according to the invention, and the operation thereof appears easily understandable.

From the now completed description of the individual components it appears evident that the mounting is particularly simple. Once spring 13 has been inserted so that it may rest below on the upper surface of collar 8, the head 9 of stem 3 is brought into engagement with the cylindrical appendix 2*f* of capsule 2, so as to maintain the axis of stem 3 perfectly centred. Subsequently, rotating ring 10 is inserted into coupling ring 12, so that the annular abutment recess 12*a* may support it, and subsequently coupling ring 12 is brought into engagement with capsule body 2*b*, simply engaging by pushing notches 12*a* into seat 2*e*. At this point, cylindrical hood 2*a* is brought to cover capsule body 2*b*.

Equally, tank 1 is first provided with scraper 13, in correspondence of the top surface of neck 4, and subsequently with plastic gasket 14 provided on the top of the container in correspondence of the protective collar of the closing member.

The operation of the device thus created appears particularly simple.

Once capsule 2 has been brought into contact with tank 1, pegs 11 are housed in rail 6: the pressure of the finger on capsule 2 pushes the pegs 11 along rail 6 until they reach the bottom surface of base crown 5; by releasing the capsule, it will be brought by spring 13 to raise back into the home position, bringing pegs 11 to find housing in the recess 7*a* of brackets 7.

Similarly, when the user wants to apply the product, he/she must only push onto capsule 2, so that pegs 11 are displaced from the equilibrium position and are induced, due to the geometries of crown 5 and of brackets 7, to raise back along rail 6.

From the preceding description it appears evident that the set objects have thus been obtained, that is, a quick-opening container, wherein greater simplicity during assembling, improved stability of the pegs when they are engaged with the guiding and retaining bodies, a longer and consequently easier opening movement, are detectable.

Moreover, it was possible to detect that the solution just described has some unexpected advantages, which, however, are not unworthy of being remembered. In particular, the simplification of the displacement and engagement system has made the rotating ring free from any other constraint, entrusting centring and guiding of the rod to the rod itself and to the capsule. This implies greater precision during device operation and greater mounting simplicity.

Moreover, the plastic material gasket provided at the top of the container in correspondence of the protective collar of the closing member takes up the double function of aesthetic improvement and of more precise guiding.

It is also evident that non-substantial changes can be made to the solution described above, accomplishing alternative embodiments, without departing from the scope of protection of the patent, which is defined by the attached claims.

Figure 10A:
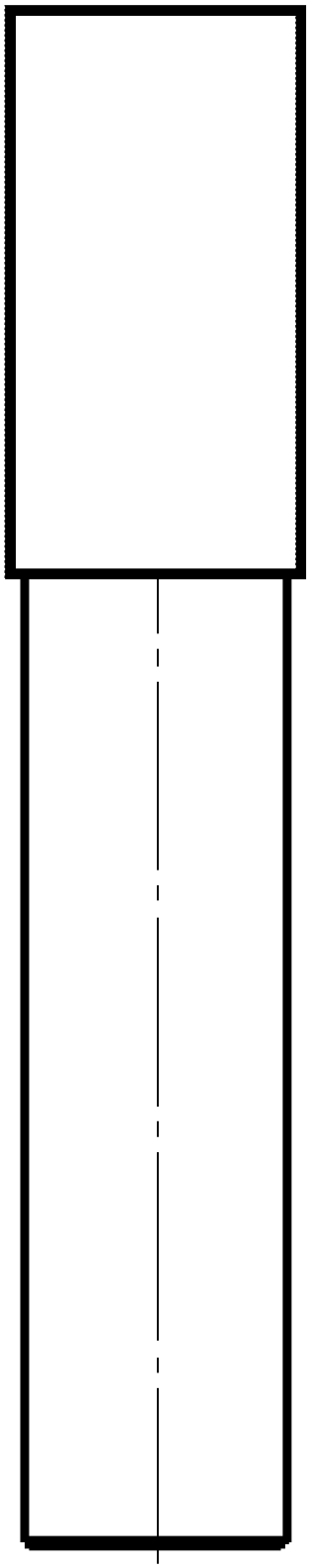
FIGS. 10*a*, 10*b* are front views of two alternative versions of the device according to the invention.
Figure 10B:
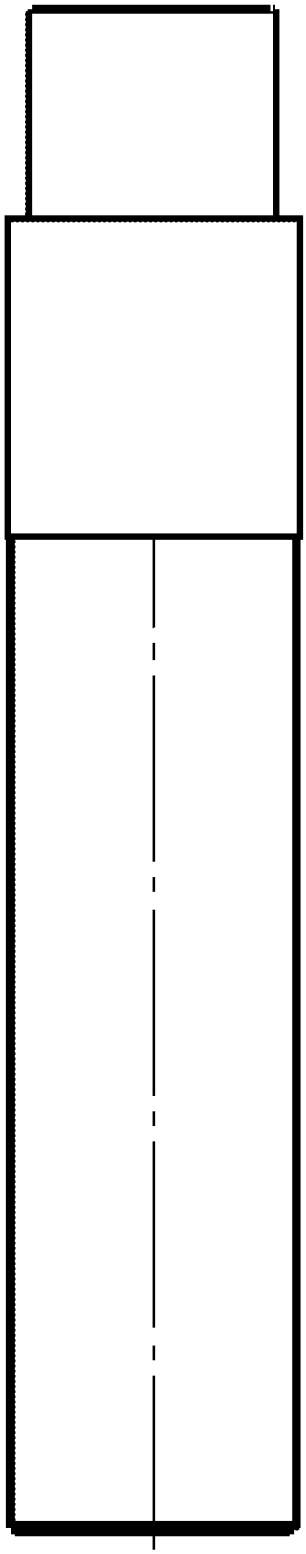

In particular, as can be observed from FIGS. 10*a* and 10*b*, it is possible to provide that tank 1 has a smaller diameter than that of capsule 2, and therefore the function of sleeve C is accomplished by the very capsule 2, and/or that gasket 15 takes up such proportions as to be able to have itself an ornamental function.

The invention claimed is:

1. Container for liquid or paste products of the type generically consisting of a tank (1) and of a closing capsule (2), a stem (3) being associated with suitable retaining means with said capsule, said stem (3) supporting an applicator, between said capsule (2) and said stem (3) a spring (13) being arranged, said tank (1) consisting of a cylindrical body, at the top of which a neck (4) is provided, apt to allow the insertion of the stem (3) and the tightening of the capsule (2) to said tank (1), on the external periphery of said neck (4) shaped relief guiding and retaining members (7) for peg members internally projecting from said capsule (2) being provided, wherein on said capsule there is provided a fastening portion (2*d*) with a cylindrical coupling ring (12) containing a rotating ring (10) carrying said peg members, apt to engage with said shaped relief guiding members provided on said neck (4).

2. Container as in claim 1, wherein said peg members consist of at least one retaining tooth (11).

3. Container as in claim 1, wherein said cylindrical coupling ring (12) has at the distal end an annular abutment recess (12*b*) supporting said rotating ring (10).

4. Container as in claim 1, wherein the fastening between said portion (2*d*) and said coupling ring (12) occurs through mechanical interlocking fastening means, respectively.

5. Container as in claim 4, wherein said interlocking fastening means consist of an annular groove (2*e*) provided on said portion (2*d*) and notches (12*a*) internally projecting from said coupling ring (12).

6. Container as in claim 1, wherein said capsule (2*b*) provides at the top end a cylindrical crown (2*f*), internally projecting, housing the head member (9) of said stem (3).

7. Container as in claim 1, wherein said stem (3) consists of a central body (3*a*), surmounted at the proximal end by a collar (8), and which in turn carries at the distal end the housing of an applicator member, from said collar (8) projecting said head member (9).

8. Container as in claim 1, wherein said relief shaped guiding members consist of a shaped base crown (5), apt to define a rail (6) which skirts said relief shaped members (7).

9. Container as in claim 8, wherein said rail (6) corresponds in certain portions to the top of said neck (4).

10. Container as in claim 1, wherein said tank (1) is covered with an ornamental and protective sleeve (C) of said tank.

11. Container as in claim 1, wherein said capsule (2) furthermore provides an external cylindrical hood (2*a*) apt to house within the capsule body (2*b*), the housing in steady position consisting of longitudinal notches (2*c*) apt to the engagement with complementary grooves provided within the hood (2*a*).

12. Container as in claim 1, wherein there is furthermore provided a gasket (15) made of plastic material, apt to the alignment of the capsule (2) with respect to the tank (1).

13. Container as in claim 1, wherein said sleeve (C) extends in height to act as a guide of the capsule (2).

14. Container as in claim 1, wherein said capsule (2*a*) has such a size as to laterally cover the tank.

* * * * *